US006286564B1

(12) United States Patent
Wallace

(10) Patent No.: US 6,286,564 B1
(45) Date of Patent: Sep. 11, 2001

(54) OPEN TOP WATER COOLER BOTTLE AND DEVICE

(76) Inventor: Loura L. Wallace, 2 N. 211 Swift Rd., Lombard, IL (US) 60148

( * ) Notice: Subject to any disclaimer, the term of this patent is extended or adjusted under 35 U.S.C. 154(b) by 0 days.

(21) Appl. No.: 09/499,210

(22) Filed: Feb. 7, 2000

(51) Int. Cl.[7] ..... B65B 3/06

(52) U.S. Cl. ..... 141/18; 141/2; 141/35; 141/327; 141/364

(58) Field of Search ..... 215/356, 396; 141/35, 106, 364, 375, 82, 2, 18, 325, 326, 327; 220/771; 222/185.1, 146.6

(56) References Cited

U.S. PATENT DOCUMENTS 3,587,904 * 6/1971 Harris ..... 220/604
4,474,303 * 10/1984 Maccise ..... 220/4.27
5,105,858 4/1992 Levinson .
5,114,042 5/1992 Sutera .
5,611,459 3/1997 Hinch .
5,957,513 9/1999 Merritt .
6,065,649 * 5/2000 Scoggins ..... 222/181.2

* cited by examiner

*Primary Examiner*—Steven O. Douglas
*Assistant Examiner*—Peter deVore
(74) *Attorney, Agent, or Firm*—Charles F. Meroni, Jr.; Meroni & Meroni, P.C.

(57) ABSTRACT

The water cooler bottle has a cylindrical body in order to enable it to be used with most water cooler units, and is enclosed on one end by a top portion and on the other end by a bottom portion. The top portion has a spout portion extending outwardly therefrom. The bottom portion with exception to a circular recessed portion is preferably horizontal in order to allow the bottle to be stored in an upright position while resting on the bottom portion. The circular recessed portion has a wall section and a floor section. The floor section has an aperture therethrough which is positioned concentrically to the cylindrical body. A circular cap is removably disposed within the circular recessed portion in order to seal the aperture. The circular cap has a top surface and a side wall peripherally extending around the cap. The top surface has a gripping means mounted thereon.

13 Claims, 4 Drawing Sheets

OPEN TOP WATER COOLER BOTTLE AND DEVICE

FIELD OF THE INVENTION

The present invention relates generally to a water cooler bottle and a water cooler system for dispensing cooled water.

DESCRIPTION OF THE PRIOR ART

Water coolers have been common fixtures at offices and homes for quite some time. These devices typically dispense bottled water which is free from the impurities associated with regular tap water. These water coolers are typically comprised of a refrigerated water dispensing unit and a large bottle of water (typically containing about 5 gallons of water).

The water dispensing unit typically has a means for receiving the water bottle on its top side. Typically the large bottle of water has a spout which must be positioned on the top side of the water dispensing unit so that the water will flow into a receiving pipe which will carry the water to a spigot typically located on the front of the water dispensing unit.

The problem with the current water coolers is the need to refill the large bottles of water. These bottles, when filled with water, will typically weigh approximately 40 pounds. The process for replacing an empty bottle of water typically entails removing the cover which seals the spout, lifting the water bottle, and inverting the water bottle so that the spout is positioned right on top of the receiving pipe. This process is quite cumbersome and requires significant strength and dexterity. Changing water bottles can lead to excessive water spillage and to injury if the person changing the water bottle lacks the strength and dexterity to perform the task.

There is prior art which has attempted to solve this problem by changing the design of the water bottle, but the prior art typically has added significant cost to the manufacture of the water bottle or has not fully addressed the problem of refilling the bottle. One such attempt to solve the problem of refilling the water bottle is disclosed in U.S. Pat. No. 5,105,858. This patent reveals a parallelepipedal shaped bottle with an elongated spout on one end and a smaller spout on the other end. The drawback in this design is that it does not conform to the shape of most water cooler bottles and subsequently will not fit in most water coolers. Secondly, the process of interconnecting the spouts located on the top of one bottle and located on the bottom portion of a second identical bottle is cumbersome and may result in excessive spillage. Furthermore, this invention does not easily adapt to the use of different bottles to refill the main bottle located on the water cooler.

Accordingly, there is a need for a water cooler bottle and a water cooler system which is easily refillable and still economical to use.

Accordingly there is also a need for a water cooler bottle which may be refilled using a variety of different water bottles.

The present invention is an easily refillable water cooler bottle and a water cooler system for dispensing cooled water.

As will be described in greater detail hereinafter, the present invention solves the aforementioned and employs a number of novel features that render it highly advantageous over the prior art.

SUMMARY OF THE INVENTION

Accordingly it is an object of this invention to provide a water cooler bottle and a water cooler system which is easily refillable and still economical to use.

Accordingly it is also an object of this invention to provide a water cooler bottle which may be easily refilled using a variety of different water bottles.

To achieve these objectives, and in accordance with the purposes of the present invention the following open top water cooler bottle and system are presented.

The water cooler bottle is preferably made of a lightweight transparent plastic, but glass may also be used. The water cooler bottle has a cylindrical body in order to enable it to be used with most water cooler units, and is enclosed on one end by a top portion and on the other end by a bottom portion.

The top portion has a spout portion extending outwardly therefrom. The spout portion has an opening which is preferably positioned concentrically to the cylindrical body. The top portion is typically received by a water dispensing unit. The spout portion is positioned in alignment with a receiving pipe in the water dispensing unit.

The bottom portion with exception to a circular recessed portion is preferably horizontal in order to allow the bottle to be stored in an upright position while resting on the bottom portion. The circular recessed portion has a wall section and a floor section. The floor section has an aperture therethrough which is positioned concentrically to the cylindrical body. The aperture allows the water cooler bottle to be refilled by simply pouring water into the water cooler bottle through the aperture. A circular cap is removably disposed within the circular recessed portion in order to seal the aperture. The circular cap has a top surface and a side wall peripherally extending around the cap. The top surface has a gripping means mounted thereon.

A water cooler bottle is loaded onto a water dispensing unit by first removing a seal covering the spout portion of the top portion and then lifting the water cooler bottle by its cylindrical body. Once the bottle is lifted and by the water dispensing unit, the water cooler bottle is inverted by grabbing the gripping means on the cap and manipulating the gripping means to invert the water cooler bottle onto the water dispensing unit.

Once the water cooler bottle is empty, the water cooler bottle can be refilled by removing the cap thereby exposing the aperture in the bottom portion. Most water bottles can be used to refill the water cooler bottle by simply positioning the spout of the water bottle in the aperture and allowing the water bottle to rest on the bottom portion partially disposed within the circular recessed portion. Gravity, the aperture, and the wall section will combine to hold most water bottles stable on the bottom portion of the water cooler bottle. Smaller and lighter one or two gallon bottles can also be used to fill up the water cooler bottle.

DESCRIPTION OF THE PREFERRED EMBODIMENT

Figure 1:
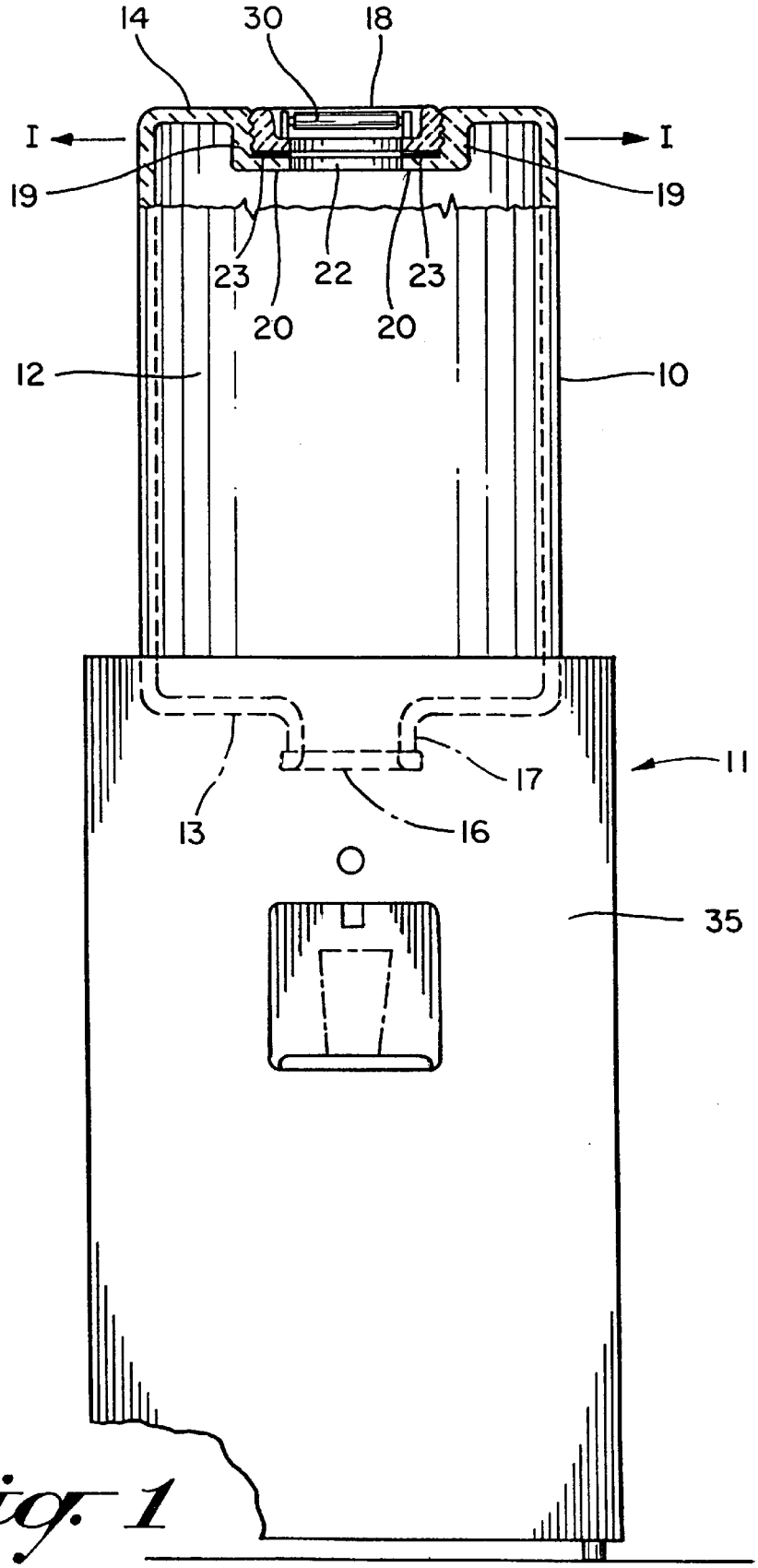
FIG. 1 is a front view of my water cooler bottle inserted into a refrigerated water dispensing unit with the bottom portion cross sectioned along the line I—I to reveal the cap and cap handle inserted therein.
Figure 5:
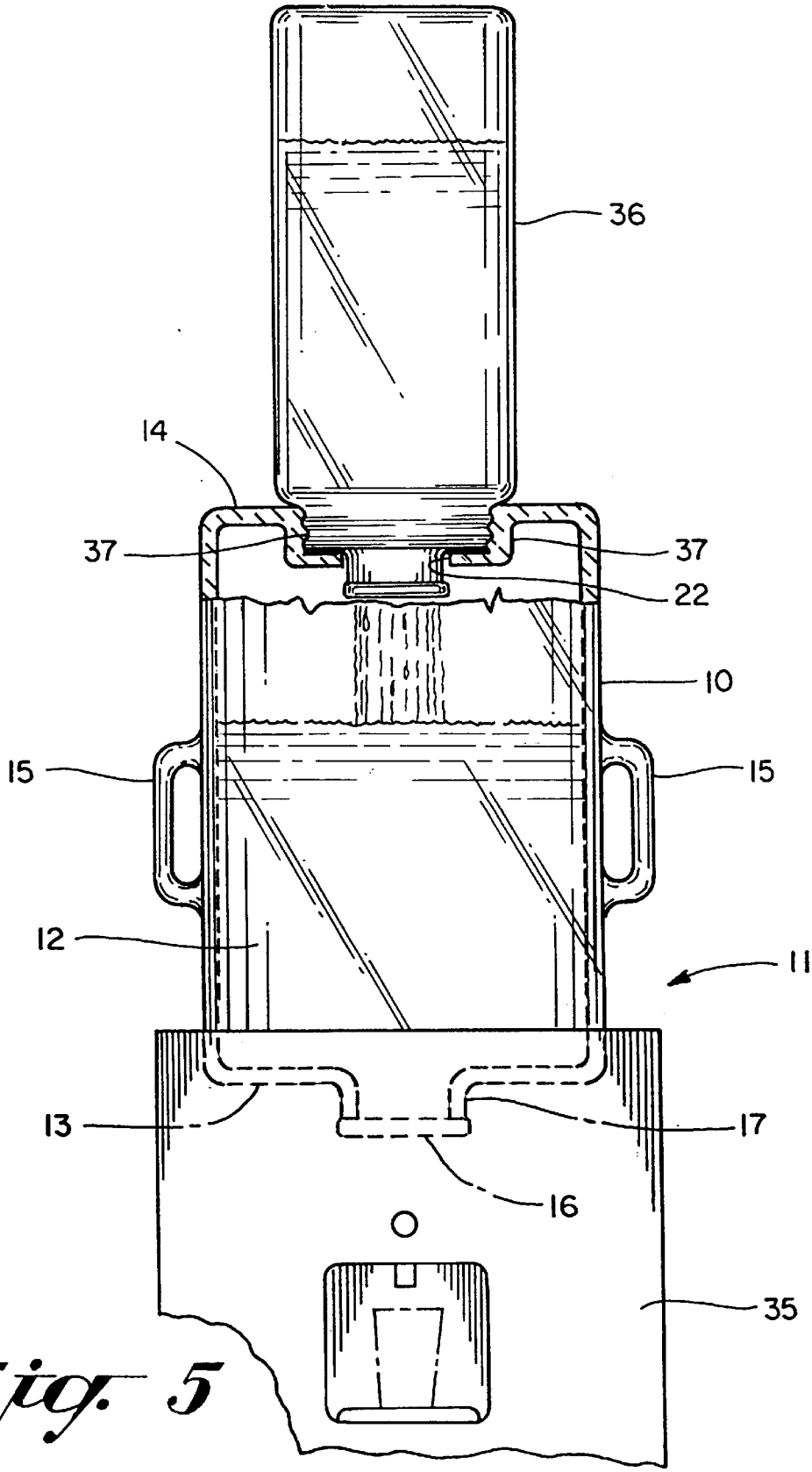
FIG. 5 is a front view of my water cooler inserted into a refrigerated water dispensing unit with the bottom portion cross sectioned along the line I—I to reveal a complementary water refill bottle inserted therein.

Referring to FIG. 1, the present invention is an easily refillable water cooler bottle 10 and a water cooler system 11 for dispensing cooled water. The water cooler bottle 10 is preferably made of a lightweight transparent plastic, but glass may also be used. The water cooler bottle has a cylindrical body 12 in order to enable it to be used with most water dispensing units, and is enclosed on one end by a top portion 13 and on the other end by a bottom portion 14. In the preferred embodiment, the water cooler has a capacity of 5 gallons. Referring to FIG. 5, in an alternative version of the water cooler, the water cooler has a plurality of bottle handles 15 which extend from the cylindrical body 12. The bottle handles 15 provide a grip which enables the water cooler bottle 10 to be easier to handle and maneuver.

Figure 2:
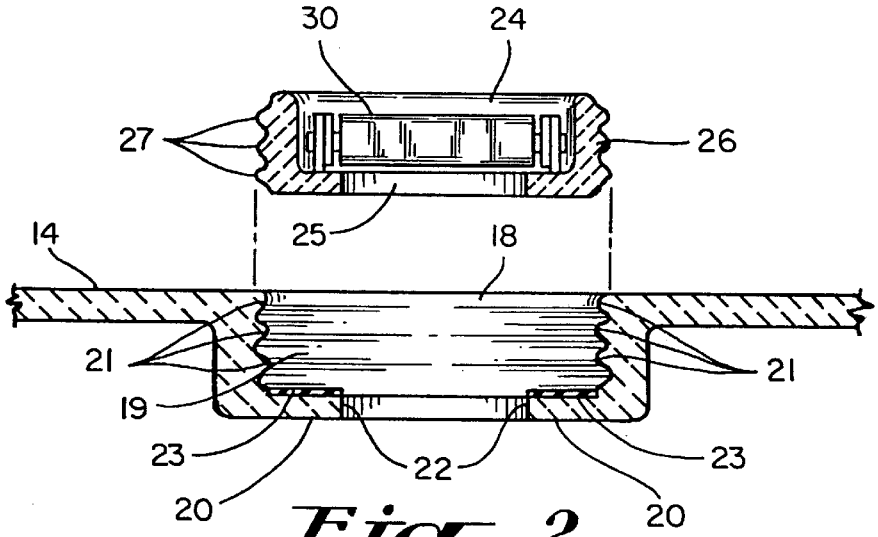
FIG. 2 is a cross section of the bottom portion in FIG. 1 along the line I—I with the cap and handle removed.

Referring to FIGS. 1 and 5, the top portion 13 has a spout portion 17 extending outwardly therefrom. The spout portion 17 has an opening 16 which is preferably positioned concentrically to the cylindrical body. The top portion 13 is typically received by a water dispensing unit, with the spout portion 17 in alignment with a receiving pipe that directs the water to a spigot on the water dispensing unit. Referring to FIGS. 1, 2, and 5, the bottom portion 14 with exception to a circular recessed portion 18 is preferably horizontal in order to allow the water cooler bottle 10 to be stored in an upright position. The circular recessed portion 18 has a wall section 19 and a floor section 20. In the preferred embodiment, the wall section has a first set of concentric threads 21 extending therefrom. The floor section has an aperture 22 therethrough which is positioned concentric to the cylindrical body, a rubber gasket 23 surrounds the aperture 22. The aperture 22 allows the water cooler bottle to be refilled by simply pouring water into the water cooler bottle 10 through the aperture 22.

The aperture is large enough to enable a person to reach inside the water cooler bottle, while still being sufficiently small to enable most water containers having a volume of 1 gallon or more to lie within the aperture without falling through. The diameter of the aperture is preferably 5 to 6 inches. The diameter of the aperture allows someone to reach inside the water cooler bottle and clean the interior of the water cooler bottle so that the water cooler bottle can be cleaned and reused.

Figure 3:
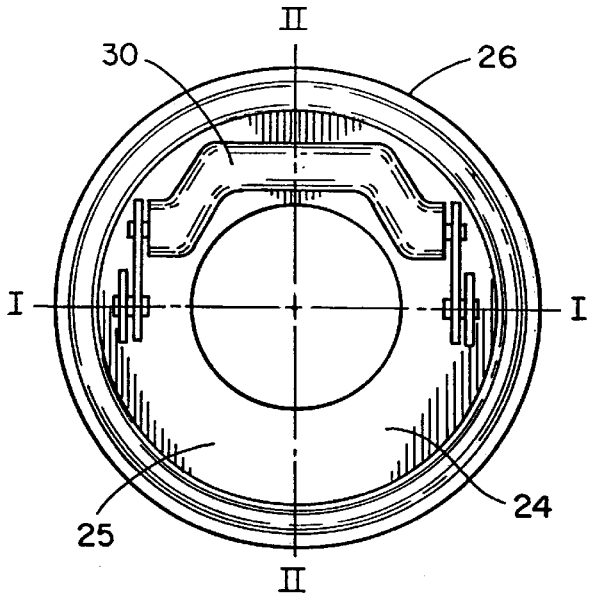
FIG. 3 is an overhead planar view of the cap and cap handle in FIG. 1.
Figure 4:
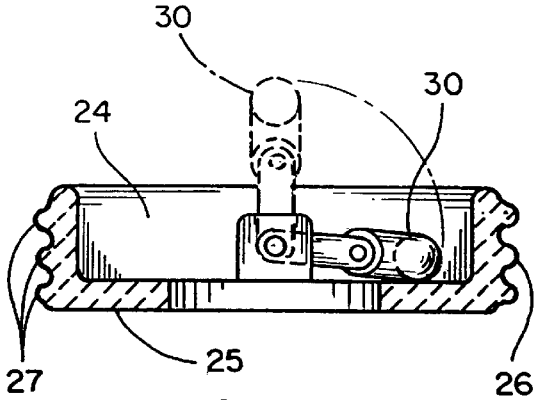
FIG. 4 is a cross section of the cap and cap handle in FIG. 3 along the line II—II.

Referring to FIGS. 2, 3, and 4, in the preferred embodiment, a circular cap 24 is removably disposed within the circular recessed portion 18 in order to seal the aperture 22. The circular cap 22 has a top surface 25 and a side wall 26 peripherally extending around the circular cap 24. The top surface 25 has a gripping means mounted thereon. A second set of threads 27 extend outwardly from side wall 26 of the circular cap. The second set of threads 27 are complementary to the first set of threads 21 on the wall section 19 of the circular recessed portion 24 allowing the circular cap 24 to screw onto the recessed portion 18 and form a water tight seal.

In the preferred embodiment, the top surface 25 of the circular cap 24 is recessed with the side wall 26 extending above the top surface 25. The gripping means on the cap is a cap handle 30 hingedly mounted onto the top surface 25 of the circular cap 24. The cap handle 30 can be raised to a vertical position relatively perpendicular to the circular cap 24 or to be lowered to a horizontal position relatively parallel to the circular cap 24. In the horizontal position, the handle is recessed within circular cap and does not interfere with the water cooler bottle's ability to sit upright on a flat surface.

Referring to FIGS. 1 and 5, a water cooler bottle 10 is loaded onto a water dispensing unit 35 by first removing a seal covering the spout portion 17 of the top portion 13 and then lifting the water cooler bottle 10 by its cylindrical body 12. In the alternative version the water cooler bottle 10 can be lifted by grabbing a bottle handle 15. Once the water cooler bottle 10 is lifted and by the water dispensing unit 35, the water cooler bottle 10 is inverted by grabbing the cap handle 30 and manipulating the cap handle 30 to invert the water cooler bottle 10 onto the water dispensing unit 35. The water dispensing unit receives the water cooler bottle and has a means for receiving fluid from the spout portion of the water cooler bottle. The water dispensing unit chills the fluid and then dispenses the fluid through a spigot.

Referring to FIGS. 5, once the water cooler bottle 10 is empty, the water cooler bottle 10 can be refilled by removing the cap thereby exposing the aperture 22 in the bottom portion 14. In the preferred embodiment, a refilling bottle 36 with a volume of preferably 3 gallons and with a third set of threads 37 on its neck is positioned over the circular recessed portion 18 of the bottom portion 14. The third set of threads 37 is complimentary to the first set of threads 21 on the wall section 19 of the bottom portion 14. The neck of the refilling bottle 36 is positioned over the aperture 22 and is screwed onto the circular recessed portion 18.

Figure 6:
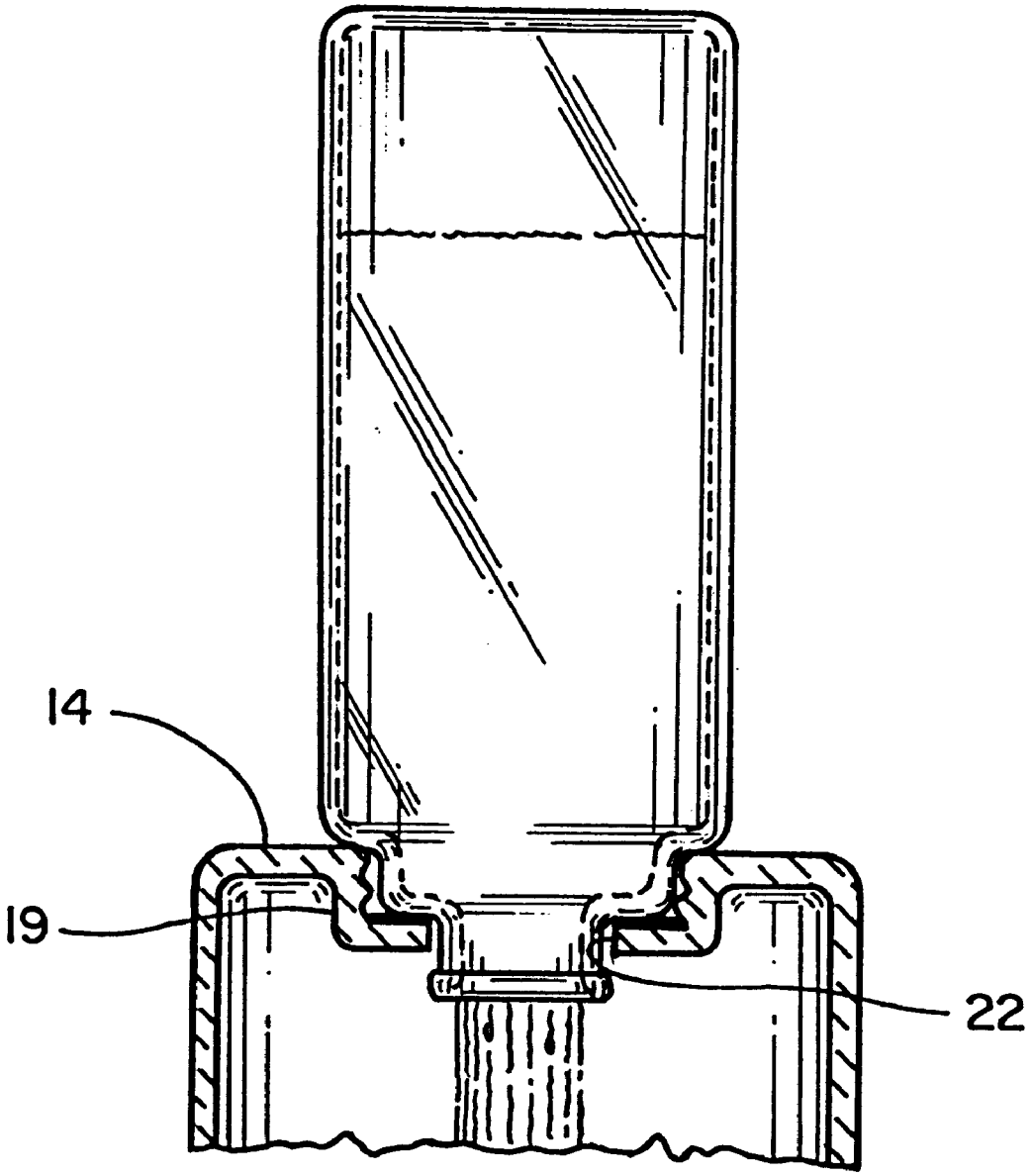
FIG. 6. is a front view of my water cooler inserted into a refrigerated water dispensing unit with the bottom portion cross sectioned along the line I—I to reveal a non complementary water refill bottle inserted therein.

Referring to FIG. 6, alternatively, most water bottles can be used to refill the water cooler bottle by simply positioning the neck of the water bottle in the aperture 22 and allowing the water bottle to rest on the bottom portion 14 partially disposed within the circular recessed portion 18. Gravity, the aperture 22, the floor section 20, and the wall section 19 will combine to hold most water bottles securely onto the bottom portion 14 of the water cooler bottle 10. Smaller and lighter one or two gallon bottles can also be used to fill up the water cooler bottle.

The foregoing descriptions of the preferred embodiments of the invention have been presented for purposes of illustration and description, and are not intended to be exhaustive or to limit the invention to the precise forms disclosed. The descriptions were selected to best explain the principles of the invention and their practical application to enable others skilled in the art to best utilize the invention in various embodiments and various modifications as are suited to be particular use contemplated. It is not intended that the novel device be limited thereby. The preferred embodiment may be susceptible to modifications and variations that are within the scope and fair meaning of the accompanying claims and drawings.

I claim:

1. A refillable water cooling station, the water cooling station comprising:

a water cooler bottle comprising a cylindrical body, the cylindrical body enclosed on one end by a top portion and on the other end by a bottom portion, the top portion having a spout portion extending outwardly therefrom, the bottom portion having a circular recessed portion with a wall section having a first set of concentric threads extending therefrom and a floor section, the wall section extending upwardly from the floor section and the floor section being flat and having an aperture therethrough wherein water can be poured into the water cooler bottle, a circular cap having a top surface and a side wall peripherally extending around the cap, the top surface having a gripping means mounted thereon, a second set of threads extending outwardly from side wall of the cap, the second set of threads being complementary to the first set of threads on the wall section allowing the cap to screw onto the circular recessed portion of the bottom portion and form a water tight seal; and a refrigerated water dispensing means, the refrigerated water dispensing means receiving the top portion of the water cooler bottle, the refrigerated water dispensing means also having a means for receiving fluid from the spout portion, and a means for dispensing the fluid.

2. The refillable water cooler cooling station in claim 1 wherein the cap has a top surface that is recessed with the side wall extending above the top surface.

3. The refillable water cooling station in claim 2, wherein the gripping means on the cap is a cap handle hingedly mounted onto the top surface of the cap allowing the cap handle to be raised to a vertical position relatively perpendicular to the cap or to be lowered to a horizontal position relatively parallel to the cap.

4. The refillable water cooling station in claim 3 wherein a plurality of handles are formed on the cylindrical body of the water cooler bottle.

5. The refillable water cooler bottle in claim 4 wherein the aperture has a diameter of 5 to 6 inches.

6. The refillable water cooling system in claim 5 wherein the refill bottle has a third set of threads located on its external surface, the third set of threads complementary to the first set of threads located on the wall section of the water cooler bottle allowing the refill bottle to be screwed onto the recessed portion of the water cooler bottle.

7. A method for refilling a water cooler station without having to replace the water cooler bottle with another filled water cooler bottle, the method comprising inserting a water cooler bottle into a water cooler station, the water cooler bottle having a bottom portion with a circular recessed portion with a wall section and a floor section, the wall section having a first set of concentric threads extending therefrom, the floor section having an aperture therethrough wherein water can be poured into the water cooler bottle, a circular cap having a top surface and a side wall peripherally extending around the cap is removably disposed within the circular recessed portion, the top surface having a cap handle mounted thereon, a second set of threads extend outwardly from side wall of the cap, the second set of threads complementary to the first set of threads on the wall section of the recessed portion allowing the cap to screw onto the recessed portion and form a water tight seal;

inserting an unsealed fluid container into the circular recessed portion of the bottom portion; and allowing fluid form the fluid container to pour into the water cooler bottle.

8. A refillable water cooling station, the water cooling station comprising:

a water cooler bottle capable of engaging a second water cooler bottle comprising a cylindrical body, the cylindrical body enclosed on one end by a top portion and on the other end by a bottom portion, the top portion having a spout portion extending outwardly therefrom and a shoulder structure surrounding the spout portion, the shoulder structure being sized and shaped for nested engagement with the bottom portion of the second water cooler bottle so that the weight of the water cooler bottle is transferred from the shoulder structure to the bottom portion of the second water cooler bottle when engaged, the bottom portion having a circular recessed portion with a wall section having a first set of concentric threads extending therefrom and a floor section, the wall section extending upwardly from the floor section and the floor section being flat and having an aperture therethrough wherein water can be poured into the water cooler bottle, a circular cap having a top surface and a side wall peripherally extending around the cap, the top surface having a gripping means mounted thereon, a second set of threads extending outwardly from side wall of the cap, the second set of threads being complementary to the first set of threads on the wall section allowing the cap to screw onto the circular recessed portion of the bottom portion and form a water tight seal; and a refrigerated water dispensing means, the refrigerated water dispensing means receiving the top portion of the water cooler bottle, the refrigerated water dispensing means also having a means for receiving fluid from the spout portion, and a means for dispensing the fluid.

9. The refillable water cooler cooling station in claim 8 wherein the cap has a top surface that is recessed with the side wall extending above the top surface.

10. The refillable water cooling station in claim 9 wherein the gripping means on the cap is a cap handle hingedly mounted onto the top surface of the cap allowing the cap handle to be raised to a vertical position relatively perpendicular to the cap or to be lowered to a horizontal position relatively parallel to the cap.

11. The refillable water cooling station in claim 10 wherein a plurality of handles are formed on the cylindrical body of the water cooler bottle.

12. The refillable water cooler bottle in claim 11 wherein the aperture has a diameter of 5 to 6 inches.

13. The refillable water cooling system in claim 12 wherein the refill bottle has a third set of threads located on its external surface, the third set of threads complementary to the first set of threads located on the wall section of the water cooler bottle allowing the refill bottle to be screwed onto the recessed portion of the water cooler bottle.

* * * * *